US010240888B2

(12) United States Patent
Italia et al.

(10) Patent No.: US 10,240,888 B2
(45) **Date of Patent: *Mar. 26, 2019**

(54) LOADER SPACER RING

(71) Applicant: GI Sportz, Inc., St. Laurent (CA)

(72) Inventors: Richmond Italia, Dorval (CA); Louis Spicer, Sewell, NJ (US)

(73) Assignee: GI Sportz, Inc., St. Laurent, Quebec (CA)

( * ) Notice: Subject to any disclaimer, the term of this patent is extended or adjusted under 35 U.S.C. 154(b) by 28 days.

This patent is subject to a terminal disclaimer.

(21) Appl. No.: 15/450,379

(22) Filed: Mar. 6, 2017

(65) Prior Publication Data

US 2017/0307326 A1 Oct. 26, 2017

Related U.S. Application Data

(63) Continuation-in-part of application No. 14/858,378, filed on Sep. 18, 2015.

(51) Int. Cl.

| | |
|---|---|
| ***F41B 11/00*** | (2013.01) |
| ***F41B 11/52*** | (2013.01) |
| ***F41B 11/70*** | (2013.01) |
| ***F41B 11/53*** | (2013.01) |
| ***B65D 21/08*** | (2006.01) |

(52) U.S. Cl.

CPC ..... *F41B 11/52* (2013.01); *B65D 21/083* (2013.01); *F41B 11/53* (2013.01); *F41B 11/70* (2013.01)

(58) Field of Classification Search

CPC ..... B65D 21/08; B65D 21/083; F41B 11/52; F41B 11/53

See application file for complete search history.

(56) References Cited

U.S. PATENT DOCUMENTS

| | | | | |
|---|---|---|---|---|
| 1,362,878 | A * | 12/1920 | Ladd | A47J 27/0808 220/323 |
| 2,545,577 | A * | 3/1951 | Griffin | A47J 27/084 220/301 |
| 3,203,579 | A * | 8/1965 | Reynolds | B60T 11/26 188/1.11 R |
| 4,852,757 | A * | 8/1989 | Gold | B65D 21/083 220/4.03 |
| 6,276,547 | B1 * | 8/2001 | Petryna | B65D 21/083 220/4.03 |
| 7,322,347 | B2 * | 1/2008 | Broersma | F41B 11/53 124/49 |
| 8,235,030 | B2 * | 8/2012 | Kaakkola | F41B 11/52 124/49 |
| 9,297,605 | B2 * | 3/2016 | Spurlock | F41B 11/53 |

(Continued)

*Primary Examiner* — John Ricci

(74) *Attorney, Agent, or Firm* — Craig R. Rogers; Simple IP Law, P.C.

(57) ABSTRACT

A loader may be provided having two or more shell segments or sections separable from each other, wherein the shell segments help define an internal chamber of the loader that is capable of housing a quantity of ammunition for a connected gun. A spacer ring can be provided to fit between at least two of the shell segments. The spacer ring may include connection mechanisms replicating connection mechanisms of the shell segments. When the loader shell segments are reattached having the spacer ring arranged therebetween, the capacity of the loader may be increased.

20 Claims, 8 Drawing Sheets

(56) References Cited

U.S. PATENT DOCUMENTS

| | | | | |
|---|---|---|---|---|
| 2008/0017178 | A1* | 1/2008 | Marques | F41B 11/53 124/51.1 |
| 2010/0126485 | A1* | 5/2010 | Neumaster | F41B 11/57 124/51.1 |
| 2011/0073092 | A1* | 3/2011 | Yeh | F41B 11/53 124/49 |
| 2011/0204048 | A1* | 8/2011 | Carino | A45F 3/18 220/4.03 |

* cited by examiner

LOADER SPACER RING

PRIORITY INFORMATION

This application is a Continuation-in-Part of, and claims priority from, U.S. patent application Ser. No. 14/858,378, filed Sep. 18, 2015, the contents of which are incorporated herein by reference in their entirety.

FIELD OF THE INVENTION

This invention relates generally to loaders, for instance such as is used in the sports of paintball and/or airsoft. More specifically, this invention relates primarily to an expansion ring that can be added to a loader to add capacity.

BACKGROUND OF THE INVENTION

In the sports of paintball and airsoft, pneumatic guns are used to deliver the paintball or airsoft pellet to a target. Loaders may be used to hold a quantity of paintballs or airsoft pellets and to supply those projectiles to the pneumatic gun. It may be desirable to have a loader with increased capacity to enable longer play times between reloading.

SUMMARY OF THE INVENTION

According to one aspect of this invention, an expansion or spacer ring is provided to enable a loader to hold a larger quantity of paintballs.

Numerous other potential embodiments are also contemplated as being within the scope of the present invention and will be readily apparent to those of skill in the art based on the following detailed description.

BRIEF SUMMARY OF THE DRAWINGS

The foregoing and additional objects and advantages of the present invention will become more readily apparent through the following detailed description, made with reference to the accompanying drawings, in which.

DETAILED DESCRIPTION

Various preferred aspects of the present inventive concepts will now be described in detail with reference to the accompanying figures. It should be noted, however, that the following description is provided by way of example only and not of limitation, and that many other implementations and embodiments of the present inventive concepts will be readily apparent to those skilled in the art based on the disclosure herein. The scope of the invention is therefore not limited to the particular embodiments described herein.

Figure 1A:
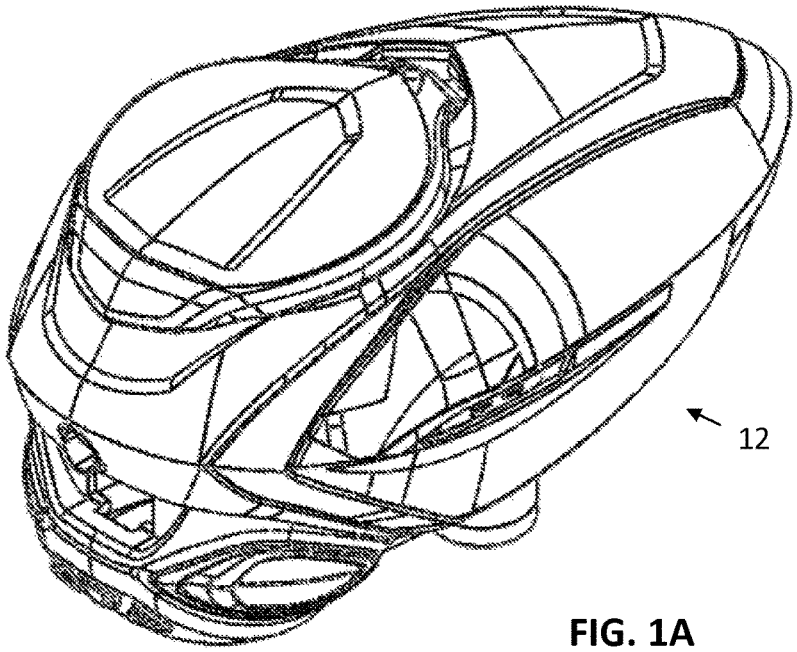
FIGS. 1A and 1B are a somewhat schematic perspective view and side view, respectively, of a paintball loader without a spacer or expansion ring.
Figure 1B:
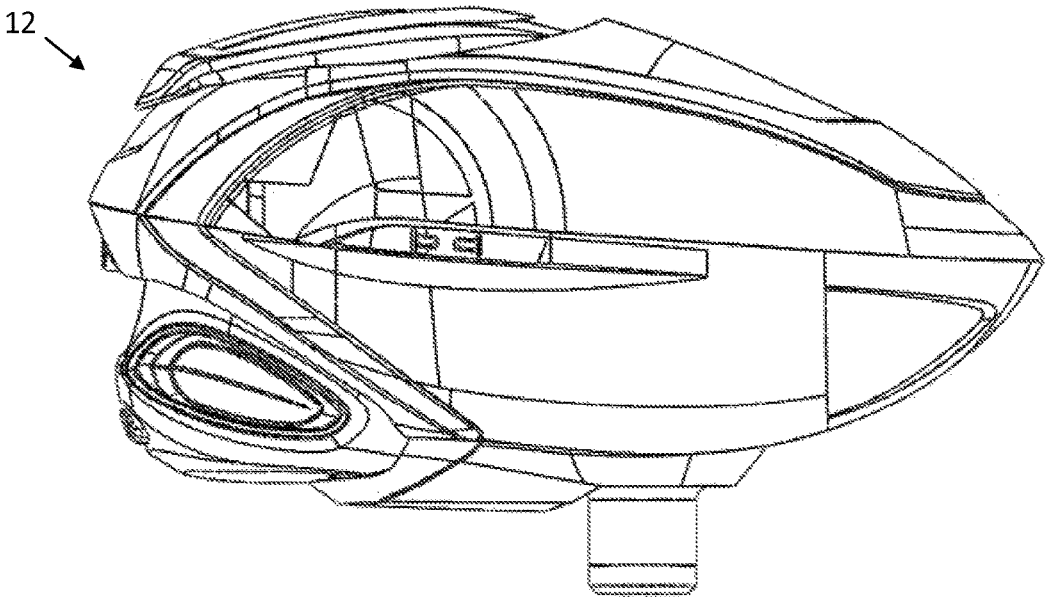
Figure 2A:
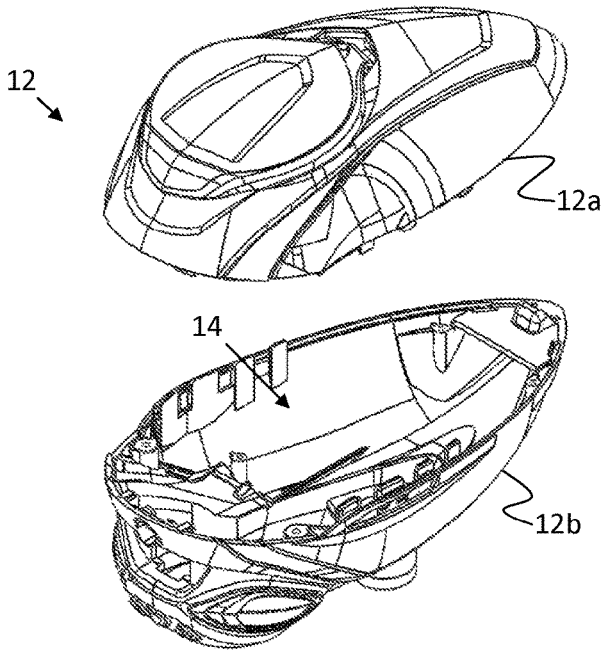
FIGS. 2A and 2B are a somewhat schematic exploded perspective view and side view, respectively, of the loader of FIGS. 1A and 1B showing two halves of the loader shell separated from each other.
Figure 2B:
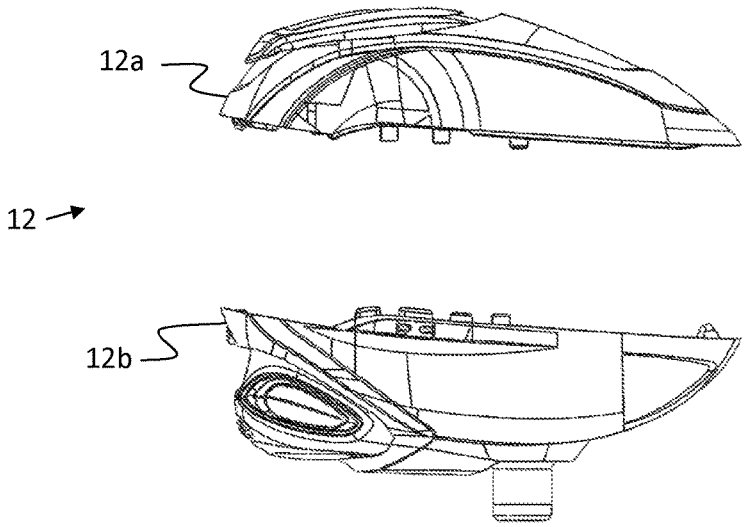
Figure 3A:
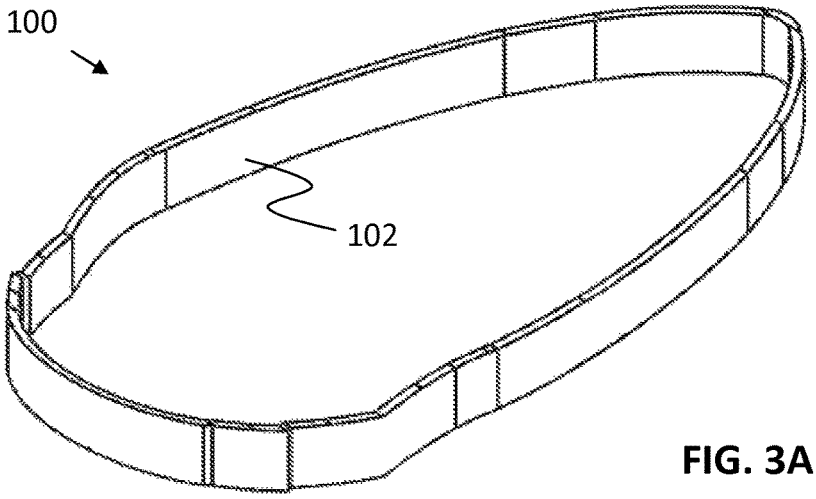
FIGS. 3A and 3B are a somewhat schematic perspective view and side view, respectively, of an expansion or spacer ring configured to be inserted between two halves of a loader shell according to an embodiment of the present inventive concepts.
Figure 3B:
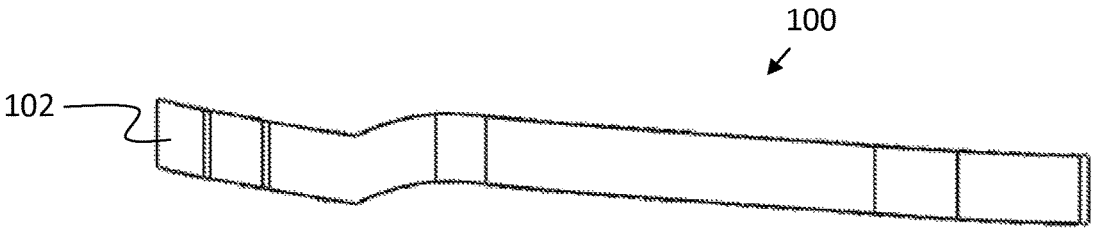
Figure 4A:
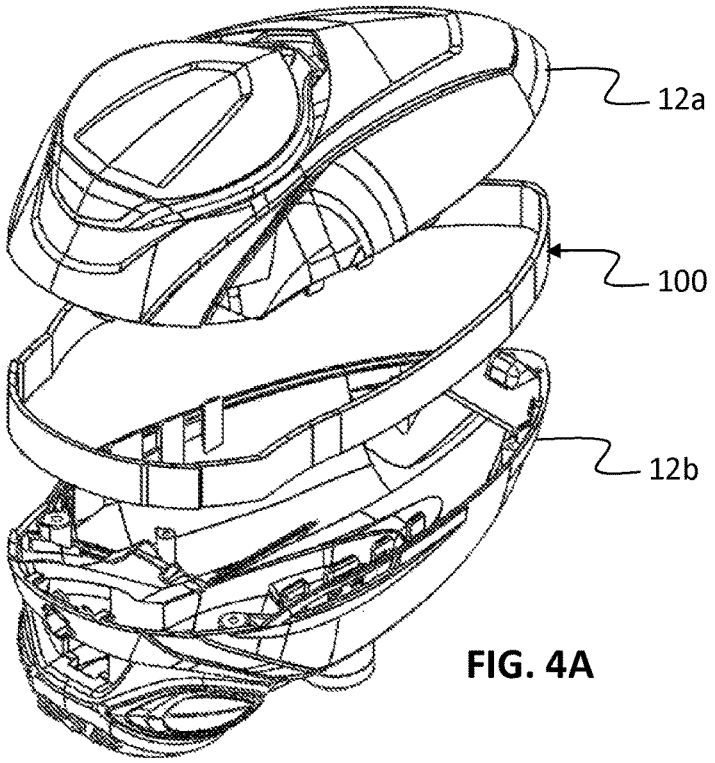
FIGS. 4A and 4B are a somewhat schematic exploded perspective view and side view, respectively, of the loader of FIGS. 1A and 1B showing the two halves of the shell separated from each other with the expansion or spacer ring of FIGS. 3A and 3B inserted between the two halves according to an embodiment of the present inventive concepts.
Figure 4B:
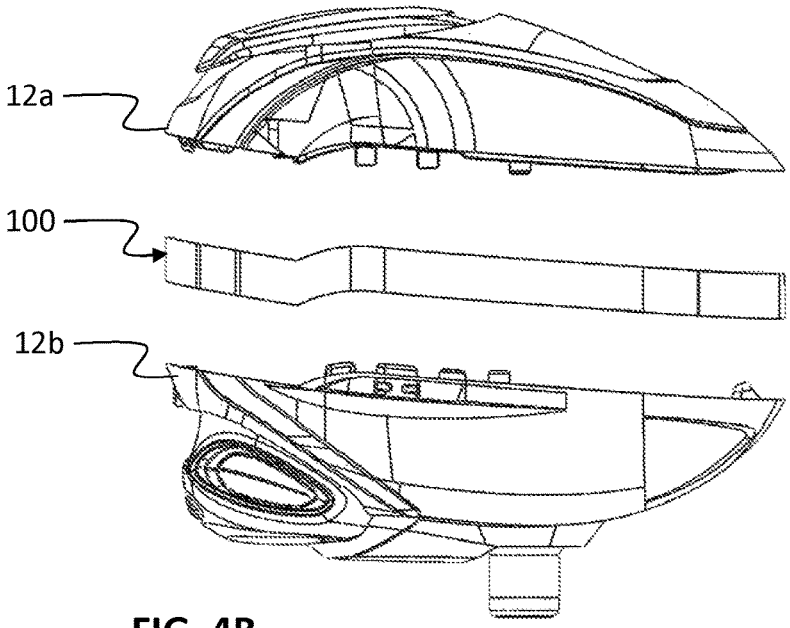
Figure 5A:
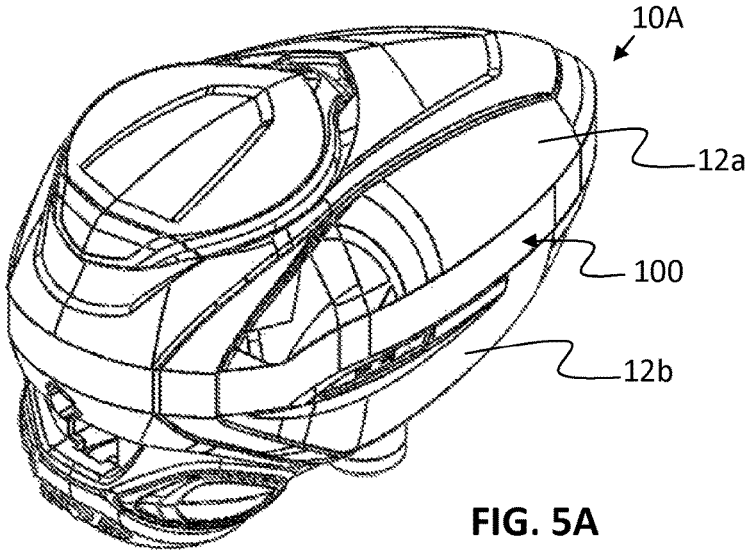
FIGS. 5A and 5B are a somewhat schematic perspective view and side view, respectively, of the loader of FIGS. 1A and 1B having the spacer or expansion ring of FIGS. 3A and 3B arranged therein in an assembled form.
Figure 5B:
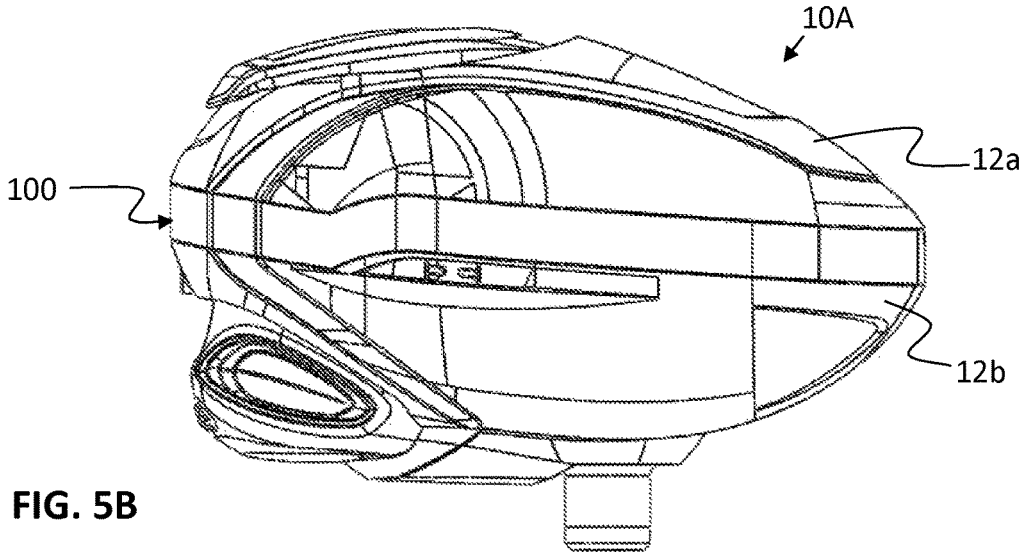

FIGS. 1A-5B provide illustrations of a loader and spacer ring constructed according to principles of the present inventive concepts. Referring to FIGS. 1A-5B, a loader 10 may be constructed having two or more segments or sections (i.e., half shells 12*a*, 12*b*) that may be separated from each other. In this embodiment, a spacer or expansion ring 100 can be configured to fit between the two half shells 12*a*, 12*b* to expand the capacity of the loader 10. As shown in FIGS. 5A and 5B, the assembled loader 10A having the spacer ring 100 fitted therein has a larger capacity than the loader 10 without the spacer ring 100 (see FIGS. 1A and 1B).

To add the spacer ring 100, the two halves 12*a*, 12*b* of the loader shell 12 may be separated from each other. The loader halves 12*a*, 12*b* may, for instance, be attached by screws or other fasteners (not shown), or they may be connected together by latches, tabs, or other readily releasable mechanical connections (also not shown). Once separated, the spacer ring 100 can be inserted between the two halves 12*a*, 12*b*, and the two halves 12*a*, 12*b* can then be reattached to each other with the spacer ring 100 arranged therebetween. In this manner, the capacity of the loader 10 can be increased.

The spacer ring 100 preferably comprises a ring-shaped housing 102 that surrounds an inner cavity or chamber 14 within the paintball loader 10. By expanding the size of the paintball loader housing, the spacer ring 100 expands the volume of the internal chamber housing the paintballs and increases the loader capacity.

ADDITIONAL EMBODIMENT

Figure 6A:
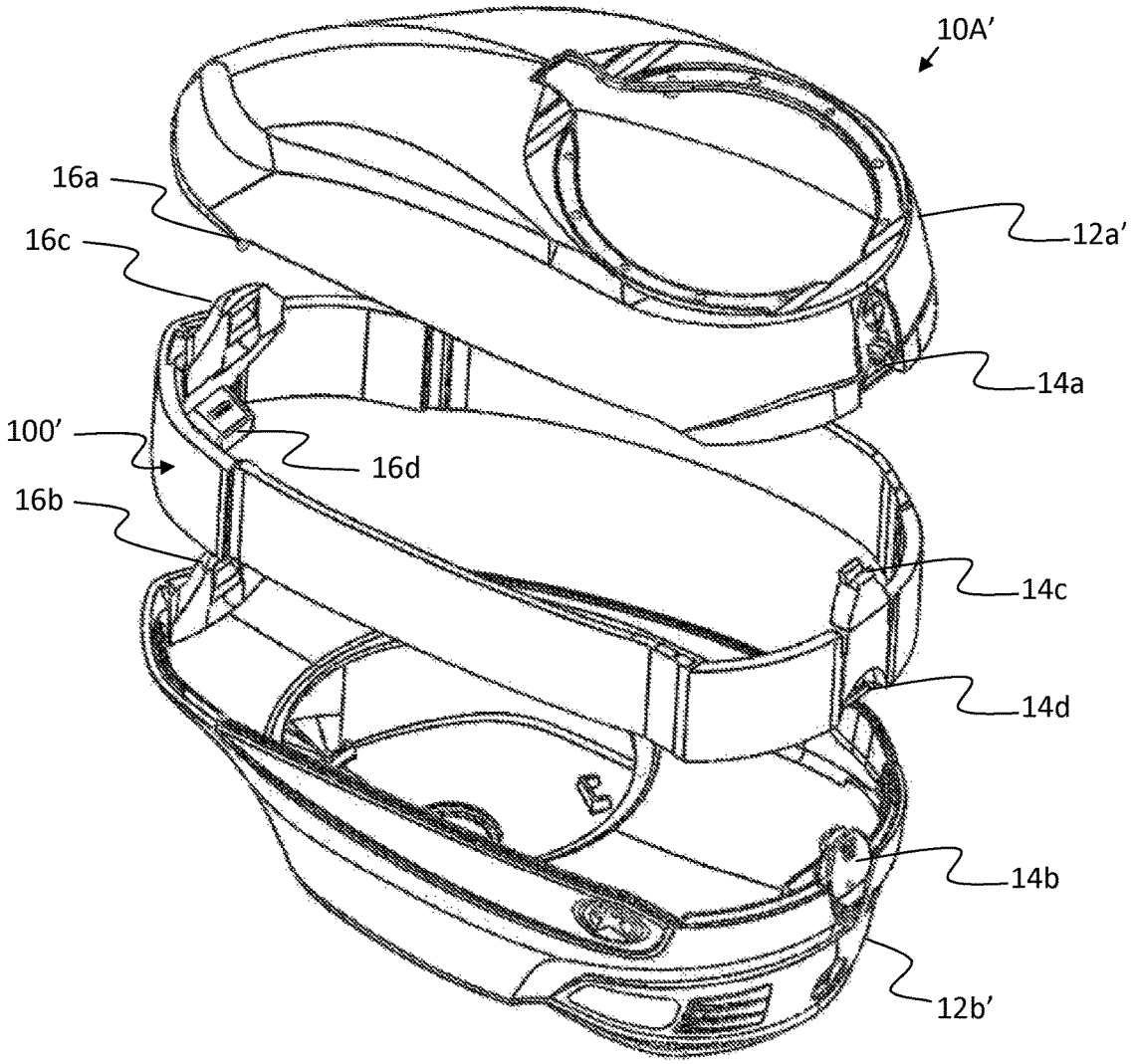
FIGS. 6A through 6C are somewhat schematic perspective and side views of a loader having a spacer or expansion ring installed therein according to an alternative embodiment of the present inventive concepts.
Figure 6B:
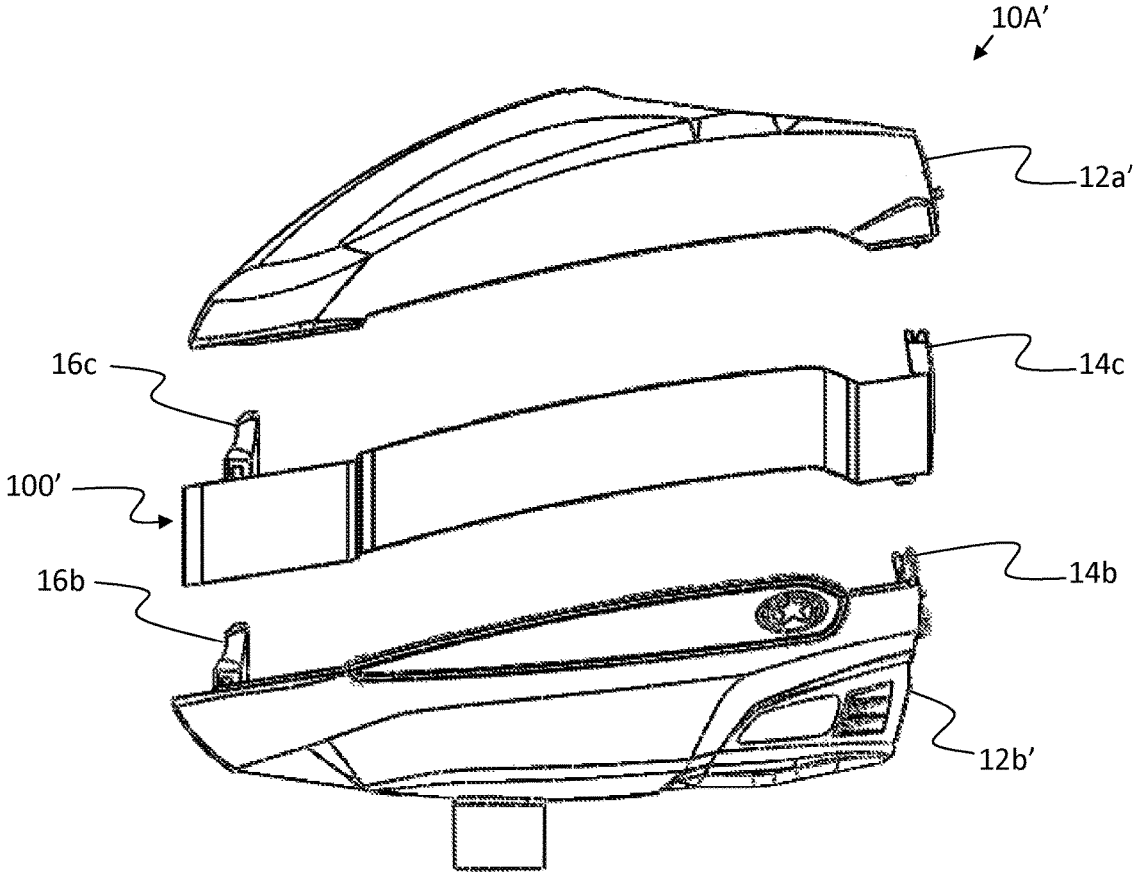
Figure 6C:
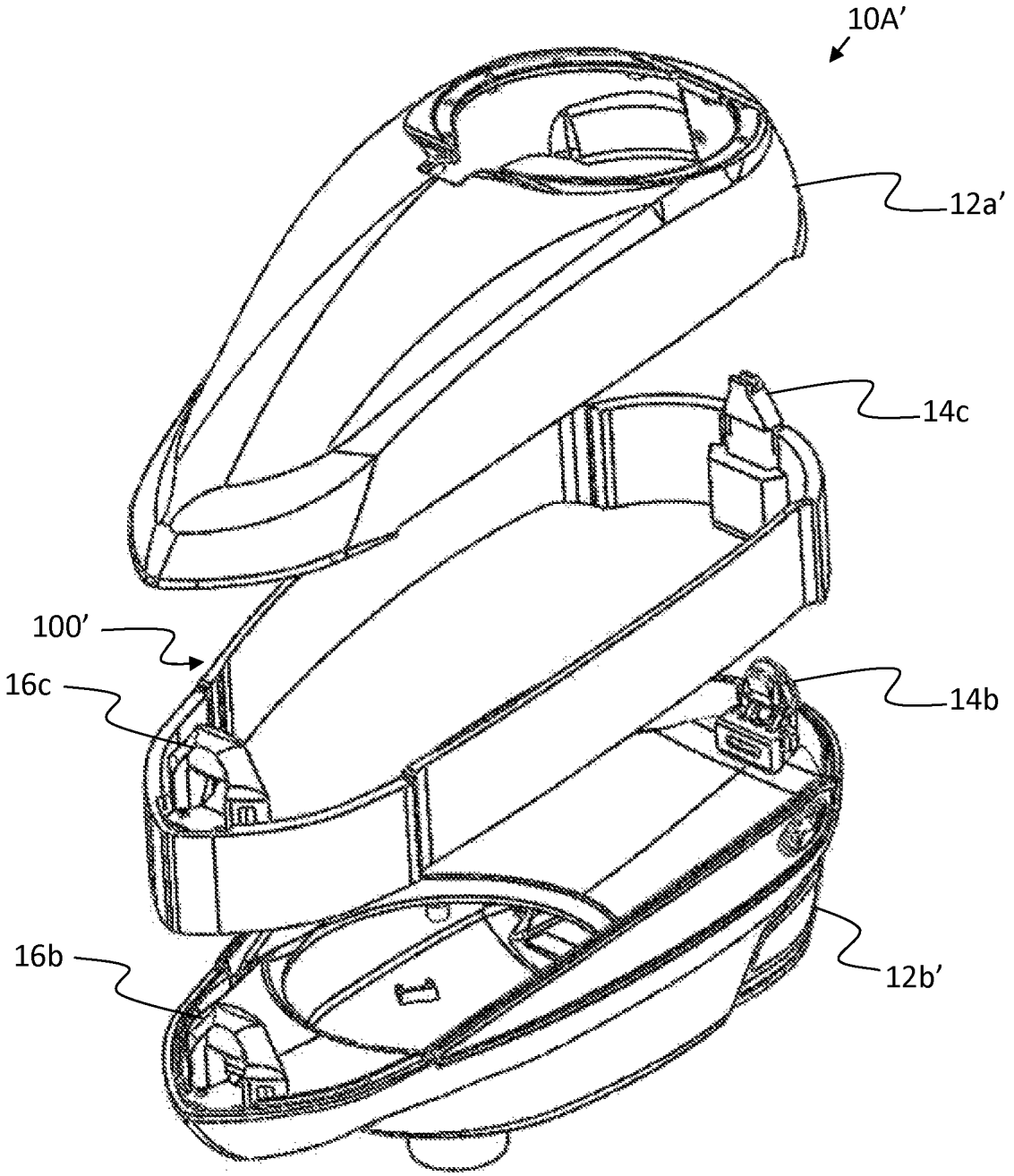

FIGS. 6A through 6C illustrate another embodiment of the present inventive concepts. More particularly, FIGS. 6A through 6C illustrate how an expansion ring 100' may be adapted for use in a loader 10A' having a particular connection mechanism for connecting the top half 12*a*' of the housing to the bottom half 12*b*' of the housing. Referring to FIGS. 6A through 6C, a loader 10A' may include a housing or shell divisible into multiple sections. Those sections may include, for instance, a top shell 12*a*' and a bottom shell 12*b*'. The top shell 12*a*' and the bottom shell 12*b*' maybe configured to attach to one another through a connection mechanism such as the latching mechanisms 14*a* and 14*b*, and 16*a* and 16*c* illustrated in FIGS. 6A through 6C, or through some other connection mechanism(s).

According to the embodiment illustrated in FIGS. 6A through 6C, the spacer or expansion ring 100' may be configured to reproduce, mirror, or replicate the connection mechanisms of the top and bottom shells 12*a*' and 12*b*', respectively, on mating portions of the expansion ring 100'. More specifically, a top portion of the expansion ring 100' may have connection mechanisms 14*c*, 16*c* that are configured to mate with, or otherwise connect to, the connection mechanisms 14*a*, 16*a* arranged on the bottom portion of the top shell 12*a*'. A bottom portion of the expansion ring 100' may have connection mechanisms 14*d*, 16*d* arranged thereon that are configured to mate with, or otherwise connect to, the connection mechanisms 14*b*, 16*b* on the bottom shell 12*b*' of the loader. In other words, the connection mechanisms which connect the sections of the loader together can be reproduced on the expansion ring to permit the expansion ring to replicate the mating features of the loader housing and readily attach between the sections of the loader.

In this specific embodiment, a latching mechanism 16*c* is arranged on the top rearward portion of the expansion ring 100' to receive a mating feature 16*a* arranged on the bottom rearward portion of the top shell 12*a*'. A mating feature 16*d* is arranged on the bottom rearward portion of the expansion ring 100' to mate with the latching mechanism 16*b* arranged on the top rearward portion of the bottom shell 12*b*'. Similarly, a clip or other connection mechanism 14*c* is arranged on the top forward portion of the expansion ring 100' to clip or otherwise connect onto a mating feature 14*a* arranged on the bottom forward portion of the top shell 12*a*'. A mating feature 14*d* is arranged on the bottom forward portion of the expansion ring 100' to connect to the releasable clip or other connection mechanism 14*b* arranged on the forward top portion of the bottom shell 12*b*'. In addition to the connection mechanisms, the shape of the housing can be reproduced along at least the top and bottom portions of the expansion ring 100' to ensure a seamless fit with the loader housing.

Having described and illustrated the principles of the inventive concepts with respect to preferred embodiments thereof, it should be apparent that those concepts can be modified in arrangement and detail without departing from such principles. As is evident from the foregoing description, numerous variations and modifications are possible within the spirit and scope of the present inventive concepts. The specification therefore should not be read to limit the scope of the claims.

What is claimed is:

1. A paintball loader and expansion ring for a paintball gun configured to expand the holding capacity of the paintball loader, said paintball loader comprising:

a housing that is separable into multiple sections and a feed tube for connecting the paintball loader to a paintball gun, and said expansion ring comprising:

an expansion ring housing configured to fit between mating sections of the paintball loader, wherein said housing is shaped to match a shape of the paintball loader housing at a mating point between the mating sections and is further configured to expand a volume of a chamber arranged within the paintball loader to expand the holding capacity of the paintball loader.

2. A paintball loader and expansion ring according to claim 1, wherein the mating sections comprise two approximately half shells such that the mating point is located approximately at a center of the paintball loader and wherein the expansion ring is configured to surround an internal chamber of the paintball loader when operatively installed between the mating sections.

3. A paintball loader and expansion ring according to claim 1, further comprising:

one or more connection mechanisms arranged on the expansion ring housing and configured to mate with one or more connection mechanisms of the mating sections of the loader.

4. A paintball loader and expansion ring according to claim 3, wherein the one or more connection mechanisms comprise separate latching and mating mechanisms arranged on both front and rearward ends of the expansion ring and loader housings.

5. A paintball loader and expansion ring according to claim 3, wherein the one or more connection mechanisms arranged on the expansion ring housing replicate one or more connection mechanisms of the mating sections.

6. A paintball loader and expansion ring according to claim 5, wherein the one or more connection mechanisms comprise:

a first connection mechanism arranged on a first mating section of the loader housing;

a second connection mechanism arranged on a second mating section of the loader housing;

a third connection mechanism arranged on the expansion ring housing; and a fourth connection mechanism arranged on the expansion ring housing, wherein the first and second connection mechanisms are configured to connect to each other to connect the first and second mating sections together when the expansion ring is not arranged therebetween, wherein the third connection mechanism is configured to replicate the second connection mechanism and connect to the first connection mechanism when the expansion ring is arranged between the first and second mating sections, and wherein the fourth connection mechanism is configured to replicate the first connection mechanism and connect to the second connection mechanism when the expansion ring is arranged between the first and second mating sections.

7. A paintball loader and expansion ring according to claim 6, wherein the one or more connection mechanisms further comprise:

a fifth connection mechanism arranged on the first mating section;

a sixth connection mechanism arranged on the second mating section;

a seventh connection mechanism arranged on the expansion ring housing; and an eighth connection mechanism arranged on the expansion ring housing, wherein the fifth and sixth connection mechanisms are configured to connect to each other to connect the first and second mating sections together when the expansion ring is not arranged therebetween, wherein the seventh connection mechanism is configured to replicate the sixth connection mechanism and connect to the fifth connection mechanism when the expansion ring is arranged between the first and second mating sections, and wherein the eighth connection mechanism is configured to replicate the fifth connection mechanism and connect to the sixth connection mechanism when the expansion ring is arranged between the first and second mating sections.

8. A paintball loader and expansion ring according to claim 1, wherein the expansion ring housing comprises a substantially oblong shape.

9. A paintball loader and expansion ring according to claim 8, wherein the loader housing comprises a substantially oblong shape at the mating point between the two or more mating sections.

10. A paintball loader and expansion ring according to claim 1, wherein the expansion ring housing includes two or more connection mechanisms configured to replicate connection mechanisms of a top section of the loader and two or more connection mechanisms configured to replicate connection mechanisms of a bottom section of the loader.

11. A loader comprising:

a housing having an internal chamber configured to house a quantity of ammunition for a connected pneumatic gun, the housing having multiple mating sections separable from each other; and a removable spacer ring configured to be removably arranged between at least two mating sections of the loader to expand a volume of the internal chamber when arranged between the at least two mating sections.

12. A loader according to claim 11, wherein the multiple mating sections comprise a top shell and a bottom shell, and wherein the spacer ring is configured to be removably arranged between the top shell and the bottom shell to expand the volume of the internal chamber when arranged between the top shell and the bottom shell, and wherein the bottom shell comprises a feed tube configured to connect to the pneumatic gun.

13. A loader according to claim 11, wherein the each of the at least two mating sections comprises one or more connection mechanisms configured to connect the at least two mating sections together, and wherein the removable spacer ring comprises one or more connection mechanisms configured to replicate connection mechanisms of the at least two mating sections between which it is configured to be removably arranged.

14. A loader according to claim 13, wherein the one or more connection mechanisms comprise:

a first connection mechanism arranged on a first mating section of the loader housing;

a second connection mechanism arranged on a second mating section of the loader housing;

a third connection mechanism arranged on the removable spacer ring housing; and a fourth connection mechanism arranged on the removable spacer ring housing, wherein the first and second connection mechanisms are configured to connect to each other to connect the first and second mating sections together when the removable spacer ring is not arranged therebetween, wherein the third connection mechanism is configured to replicate the second connection mechanism and connect to the first connection mechanism when the removable spacer ring is arranged between the first and second mating sections, and wherein the fourth connection mechanism is configured to replicate the first connection mechanism and connect to the second connection mechanism when the removable spacer ring is arranged between the first and second mating sections.

15. A loader according to claim 11, wherein the removable spacer ring comprises an housing shaped to match the shape of the mating sections between which the removable spacer ring is configured to be arranged.

16. A method of expanding a holding capacity of a loader for a pneumatic gun, wherein said loader comprises multiple separable sections and a mechanism for connecting the loader to the pneumatic gun, said method comprising:

separating at least two sections of the loader from each other, wherein the at least two sections help define an internal chamber of the loader capable of housing a quantity of ammunition for the pneumatic gun;

arranging a spacer ring between the at least two sections of the loader; and reattaching the at least two sections of the loader to each other with the spacer ring arranged between the at least two sections such that a volume of the internal chamber is increased.

17. A method according to claim 16, wherein the spacer ring comprises an housing shaped to match the shape of the two loader sections.

18. A method according to claim 16, wherein reattaching the at least two sections of the loader to each other comprises attaching each of the two sections of the loader to the spacer ring.

19. A method according to claim 18, wherein the attaching each of the two sections of the loader to the spacer ring comprises attaching connection mechanisms arranged on the two sections of the loader to connection mechanisms arranged on the spacer ring.

20. A method according to claim 19, wherein connection mechanisms on the spacer ring replicate connection mechanisms on the two sections of the loader.

* * * * *